United States Patent [19]

Unterweger et al.

[11] 4,065,805

[45] Dec. 27, 1977

[54] CIRCUIT ARRANGEMENT IN AN ELECTRICAL DEVICE OPERATED WITH DIRECT-CURRENT, ESPECIALLY IN A TIMING RELAY

[75] Inventors: Heinz Unterweger, Aarau; Maurice Grémaud, Buchs, both of Switzerland

[73] Assignee: Sprecher & Schuh AG, Aarau, Switzerland

[21] Appl. No.: 675,942

[22] Filed: Apr. 12, 1976

[30] Foreign Application Priority Data

Apr. 16, 1975 Switzerland ..... 4873/75

[51] Int. Cl.[2] ..... H01H 47/18

[52] U.S. Cl. ..... 361/196; 323/22 T

[58] Field of Search ..... 361/196, 197, 198; 307/296, 297; 323/23, 25

[56] References Cited

U.S. PATENT DOCUMENTS

| | | | |
|---|---|---|---|
| 3,406,295 | 10/1968 | Corey | 361/198 |
| 3,628,086 | 12/1971 | Nuckolls | 323/23 |
| 3,758,844 | 9/1973 | Harkenrider et al. | 323/22 T |
| 3,801,866 | 4/1974 | Schmidgall | 361/196 |
| 3,802,091 | 4/1974 | Offutt | 307/296 X |

*Primary Examiner*—Harry E. Moose, Jr.

*Attorney, Agent, or Firm*—Haseltine, Lake & Waters

[57] ABSTRACT

A circuit arrangement in an electrical device which contains a load which can be supplied with a direct-current voltage of lesser quality and electronic components which can be supplied with a direct-current voltage of greater quality, especially in a timing relay for supplying the device with energy from an alternating-current network by means of a transformer or voltage divider connectable with the alternating-current network and a subsequently connected rectifier arrangement. The rectifier arrangement connected after the transformer has an output at which there are connected a first supply branch and via a reverse current barrier a second supply branch containing smoothing means and a voltage stabilizer. The load which is to be supplied with the direct-current voltage of lesser quality is connected at the first supply branch and the electronic components to be supplied with the direct-current voltage of greater quality are connected at the second supply branch.

8 Claims, 5 Drawing Figures

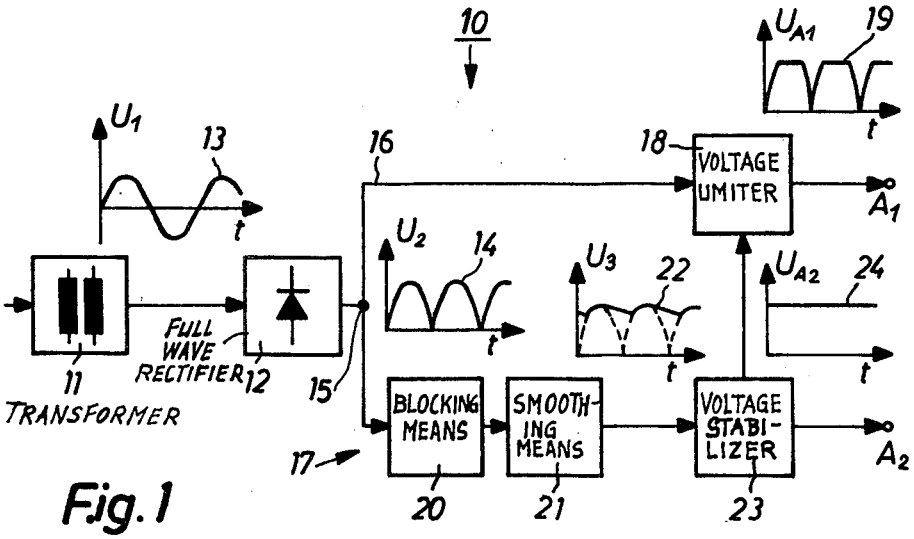
Fig. 1
Fig. 2
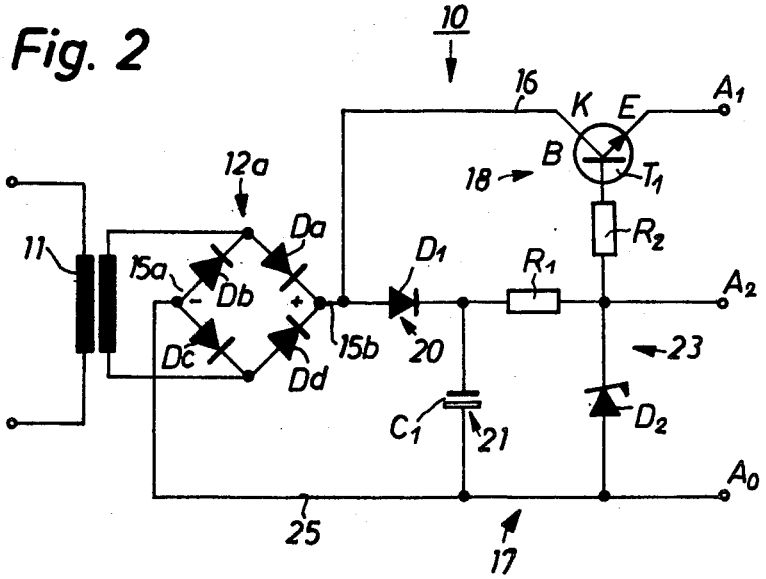

Fig. 3
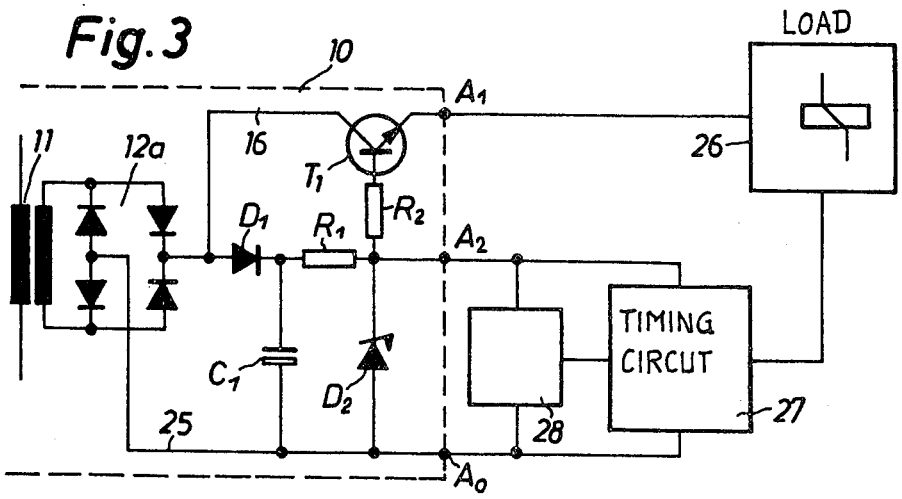
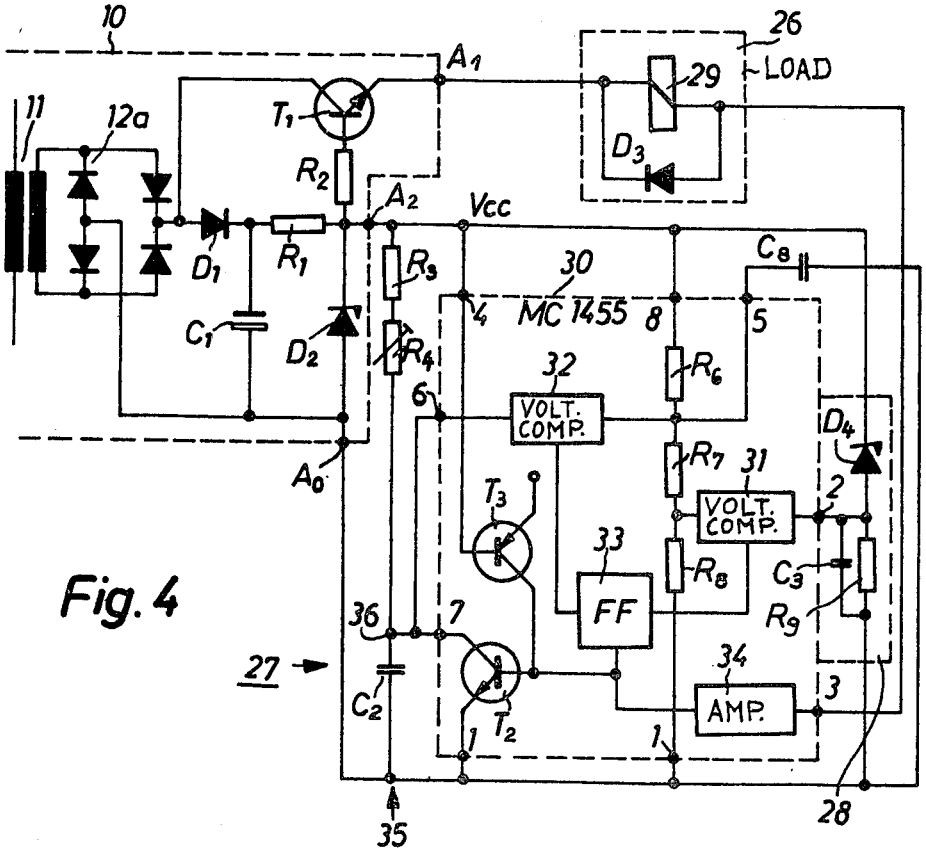
Fig. 4

CIRCUIT ARRANGEMENT IN AN ELECTRICAL DEVICE OPERATED WITH DIRECT-CURRENT, ESPECIALLY IN A TIMING RELAY

BACKGROUND OF THE INVENTION

The present invention relates to a new and improved construction of a circuit arrangement in an electrical device which contains a load supplied with a direct-current voltage of lesser quality and electronic components supplied with a direct-current voltage of greater quality, especially in a timing relay, for supplying the device with energy from an alternating-current network by means of a transformer or voltage divider, which can be connected with such network and a subsequently connected rectifier arrangement.

The heretofore known timing relays were designed for instance previously either with a non-stabilized supply or with completely stabilized supply. The timing relays equipped with non-stabilized supply have the advantage that the relay supply can be produced more economically. On the other hand as far as the timing relay itself is concerned there is present the drawback that the relay-operating voltage range of 0.8 . . . 1.1 $U_n$ ($U_n$ signifies the rated operating voltage) according to operating class C of IEC 2552 can only be realized with difficulty or great expenditure and due to the non-stabilized supply voltage and its ripples the timing accuracy of the timing relay is faulty. If there is provided a large charging capacitor in order to reduce the ripples i.e. for smoothing purposes, then the time needed for the timing relay to again assume a preparatory state is increased, so that the field of application of the relay in operation is impaired. In the case of timing relays with completely stabilized supply the operating class C can be realized without difficulty and the timing accuracy is satisfactory. However, the supply is expensive and complicated and to realize a faultless complete stabilization there is required for the supply circuit a large charging capacitor which impairs the operational readiness of a completely stabilized time relay.

In the case of a timing relay the electromechanical relay, which can be operated with a direct current supply possessing a large amount of ripples and provided that one does not drop below the holding current, constitutes the load which can be supplied with a direct-current voltage of lesser quality and the timing circuit with the RC-element form the electronic components of the previously mentioned electrical device which are to be supplied with a direct-current voltage of greater quality i.e. a constant direct-current voltage with less ripples. in such electrical devices there are thus present the same or similar defects as with the previously discussed timing relay. In summation then, electrical devices of the previously mentioned type with a non-stabilized power supply are generally inexpensive to fabricate but less accurate and therefore at the present time unsatisfactory in operation, and those with completely stabilized supply expensive to manufacture but then also accurate in operation. Furthermore, with such electrical devices the entire infed power must be converted to heat, so that a pronounced heating of both the load as well as also the electronic components can impair the proper functioning of the device and that disturbing or fault pulses can be delivereed from the network via the supply, which then must be suppressed in order to eliminate operational errors.

SUMMARY OF THE INVENTION

It is a primary object of the present invention to provide an improved circuit arrangement of the previously mentioned type which is not associated with the aforementioned drawbacks and limitations.

Another and more specific object of the invention is to provide a circuit arrangement in an electrical device of the previously mentioned type, especially a timing relay, by means of which it is possible to eliminate the aforementioned defects and wherein with less expenditure it is possible to attain an accurate and satisfactory operation of the electrical device.

Now in order to implement these and still further objects of the invention, which will become more readily apparent as the description proceeds, the invention contemplates connecting at the output of the rectifier arrangement connected after the transformer a first supply branch and via a reverse current barrier a second supply branch containing a smoothing means and a voltage stabilizer. The load which is supplied with a direct-current voltage of lesser quality is connected with the first supply branch and the electronic components to be supplied with the direct-current supply of greater quality is connected with the second supply branch. The first supply branch can be dimensioned in accordance with the requirements of the load connected thereat, there being preferably connected in the first supply branch a voltage limiter by means of which the maximum voltage peak can be held lower than the amplitude of the rectified voltage delivered by the rectifier arrangement. In this way there can be prevented an additional heating of the load with increasing operating voltage. Similarly, the second supply branch can be optimumly accommodated, independent of the first supply branch, to the requirements of the electronic components connected thereat. Moreover, the smoothing means, in the simplest case a capacitor, and the voltage stabilizer, preferably a Zener diode, at which there is applied via a resistor the smoothed voltage, can be just dimensioned for a direct-current voltage supply of very high quality because of the generally relatively low power requirements of the electronic components. The voltage limiter connected in the first supply branch can be a transistor, at the base of which there is applied via a resistor the stabilized supply voltage of the second supply branch, so that the supply voltage of the first supply branch has a trapezoidal-wave shape with constant peak value and steep ascending and descending flanks, which is of advantage for an electromechanical relay as load in order to obtain a higher operating class.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a block circuit diagram of a supply circuit arrngement designed according to the invention;

FIG. 2 is a circuit diagram of a preferred simple constructional variant of the supply circuit arrangement of FIG. 1;

FIG. 3 illustrates the supply circuit arrangement of FIG. 2 in a timing relay which has been shown in the form of a block circuit diagram;

FIG. 4 illustrates the supply circuit arrangement of FIG. 2 in a cut-in delayed timing relay.

DETAILED DESCRIPTION OF THE INVENTION

Figure 5:
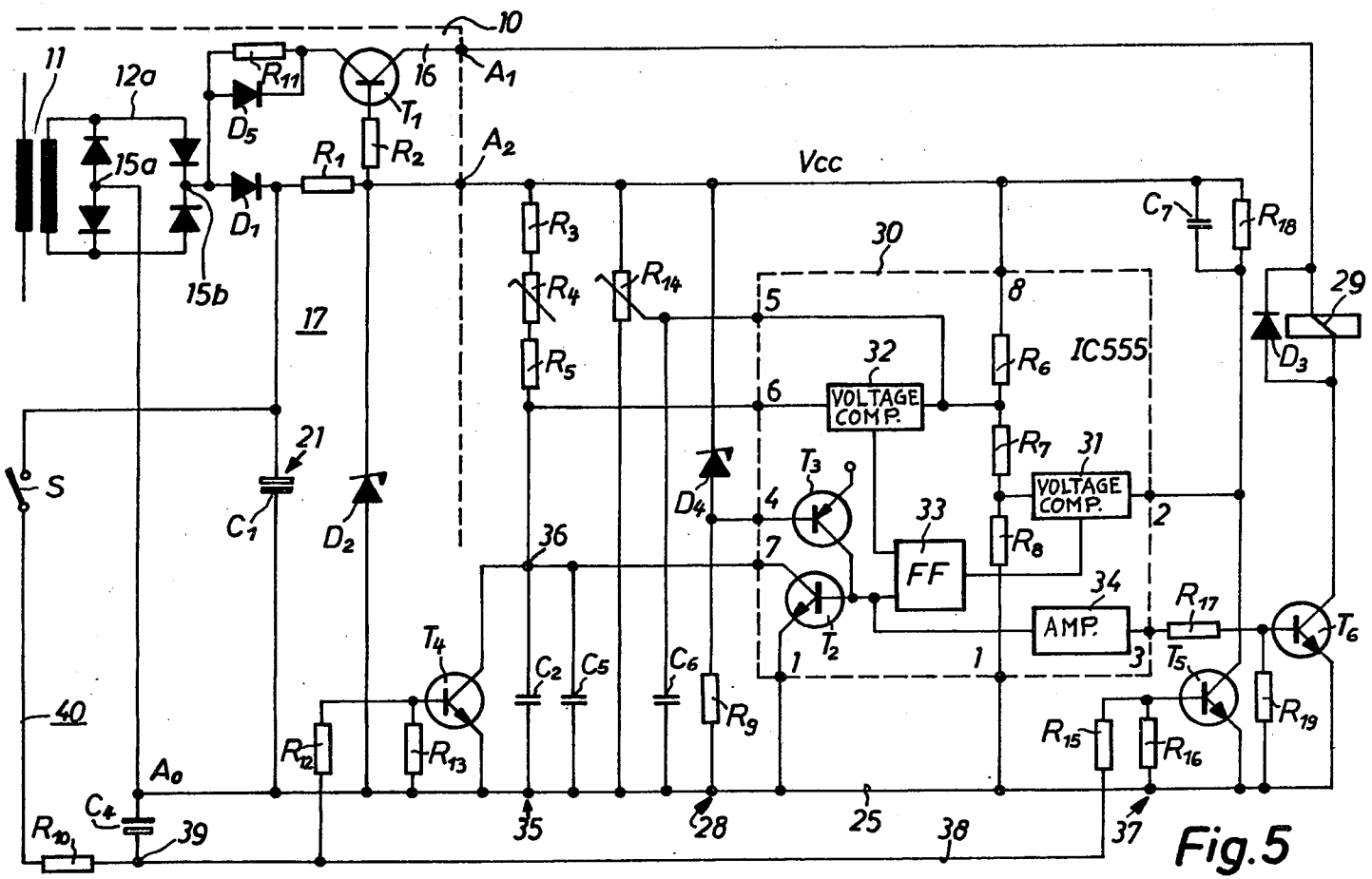
FIG. 5 illustrates the supply circuit arrangement of FIG. 2 in a cut-off delayed timing relay.

Describing now FIG. 1 the supply circuit arrangement has been indicated in its entirety by reference character 10. This supply circuit arrangement 10 contains firstly, as is usual, a transformer 11 by means of which for instance the network alternating-current is transformed to a proper value for the electrical device to be connected. The circuit arrangement further contains a rectifier arrangement or unit 12 connected with the transformer 11 and preferably designed as a full wave rectifier. At the output of the transformer 11 there is obtained the essentially sinusoidal alternating-current voltage $U_1$ and at the output of the rectifier arrangement 12 the corresponding rectified voltage $U_2$ in the form of successive, for instance positive half waves, as such has been shown in the graphs 13 and 14 of FIG. 1.

At the output 15 of the rectifier arrangement 12 there are connected a first supply branch 16 with the output terminal $A_1$ and a second supply branch 17 with the output terminal $A_2$. The first supply branch 16 serves for the current supply of the components or loads provided in the connected electrical device, the operating direct-current voltage of which can be of reduced quality and therefore can exhibit a certain amount of ripples, as such for instance is the case with electromechanical components, relays and so forth. The output terminal $A_1$ therefore is connected either directly or, as shown in FIG. 1, through the agency of a voltage limiter 18 with the rectifier arrangement 12. Due to the provision of a voltage limiter 18 in the first supply branch 16 there is provided for the supply circuit arrangement 10 a very wide field of application, since then the output direct-current voltage $U_{A1}$ at the output terminal $A_1$ has the tradpezoidal wave shape schematically shown by the graph 19 of FIG. 1. The second supply branch 17 serves for supplying the electronic components provided in the circuit connected electrical device and for which there is generally required an operating direct-current voltage of greater quality, i.e. a constant voltage with very little ripples. Here the disturbing pulses emanating for instance from the network should be suppressed as much as possible. In order to produce this direct-current voltage of greater quality the second supply circuit 17 contains, as usual, smoothing means 21 by means of which there is smoothed the rectified voltage $U_2$ of the rectifier arrangement 12 and there is obtained a voltage $U_3$ of the wave shape shown schematically by the graph 22. The second supply circuit 17 further contains a voltage stabilizer 23 which then delivers to the output connection or terminal $A_2$ the stabilized output voltage $U_{A2}$ shown in the graph 24. The components and load connected at the output terminal $A_1$ of the first supply branch 16 generally possess a considerably greater energy requirement than the electronic components connected with the second supply branch 17. In order that the smoothing of the rectified voltage $U_2$ by the smoothing means 21 is not impaired by current flow in the first supply branch 16, i.e. by a reverse current, a reverse current barrier or blocking means 20 is connected in the second supply branch 17 ahead of the smoothing means 21, and which barrier or blocking means only permits current flow from the rectifier arrangement 12 to the smoothing means 21 and prevents current flow from the smoothing means 21 to the first supply branch 16.

FIG. 2 shows with greater detail a circuit diagram of a particularly simple embodiment of this supply circuit arrangement 10. Connected with the transformer 11 is a conventional full wave rectifier 12*a* connected together from four diodes $D_a$, $D_b$, $D_c$, $D_d$. The negative output 15*a* of the full wave rectifier 12*a* is connected by a conductor 25 with the common ground terminal $A_o$. The first supply branch 16 connected with the positive output 15*b* of the full wave rectifier 12*a* contains as the voltage limiter 18 an npn-transistor $T_1$, the collector-emitter path KE of which connects the rectifier output 15*b* with the output terminal $A_1$. The second supply branch 17 likewise connected with the positive output 15*b* of the full wave rectifier 12*a* contains as the reverse current barrier or blocking means 20 a diode $D_1$, as the smoothing means 21 a capacitor $C_1$ and as the voltage stabilizer 23 a resistor $R_1$ and a Zener diode $D_2$. The aforementioned circuit components $D_1$, $R_1$, $C_1$, $D_2$, are connected together in conventional manner as is so for such stabilizer circuits and as illustrated in FIG. 2 and coupled with the output terminal $A_2$. The base B of the transistor $T_1$ connected in the first supply branch 16 is likewise connected by a resistor $R_2$ with the voltage stabilizer 23. During operation the capacitor $C_1$ is charged by the current flowing through the diode $D_1$ and partially again discharged across the resistor $R_1$. A discharge of the capacitor $C_1$ through the first supply branch 16 is prevented by the diode $D_1$. The transistor $T_1$ has the function of limiting the voltage at the output 15*b* of the full wave rectifier 12*a* to a value suitable for the load and its drive elements.

FIG. 3 illustrates an example of the use of the supply circuit arrangement of FIG. 2 in a timing relay which is illustrated in the form of a block circuit diagram. Such a timing relay constitutes an electrical device of the type which here comes under consideration and previously described and contains as an assembly or load which can be supplied with an operating voltage of reduced quality an electromagnetic relay 26 of conventional construction and as the electronic components to be supplied with a supply voltage of greater quality a timing circuit 27 by means of which there is controlled the relay 26 to cut-off or cut-on such with time delay. Consequently, the relay 26 is connected to the output terminal $A_1$ of the first supply branch 16 and the timing circuit 27 is connected to the output terminal $A_2$ of the second supply branch 17 of the supply circuit arrangement 10. The timing circuit 27 is generally equipped with a flip-flop stage which by being switched from one switching state to its other switching state brings about the time-delayed control of the relay 27. The circuit block designated by reference character 28 in FIG. 3 serves for setting the starting conditions for the flip-flop stage of the timing circuit, so that when turned-on there is obtained a defined condition. The operating voltage delivered from the supply circuit arrangement 10 in the first supply branch and second supply branch correspond completely to the requirements of a timing relay. By means of the voltage limiter 18 in the first supply branch 16 there is insured that the relay 26 will not impermissibly heat-up with increased operating voltage. Further, by virtue of an appropriate dimensioning of the circit arrangement there can be realized, even in the case of reduced operating voltage, sufficient reserve in the supply, so that viewed in its entirety also in the case of operating voltage fluctuations over a greater range there is insured for a faultless functioning of the relay. So that also there is not dropped below the holding current in the relay 26 and to protect the control elements against excessive voltages a diode $D_3$ is connected in parallel, as is conventional, to the relay winding 29 (FIGS. 4 and 5). In the second supply branch 17 the operating direct-current voltage is of greater quality due to the smoothing and stabilization, so that there is insured a correspondingly greater timing accuracy of the timing relay. Since only the supply voltage is smoothed for the timing circuit requiring little energy, the capacitor $C_1$ can have relatively low capacitance, so that there is thus realized the generally desired times needed for such timing relay to again be operationally ready.

FIG. 4 illustrates with greater detail the construction of a cut-on delayed timing relay containing the supply circuit arrangement of FIG. 2. In the illustrated exemplary embodiment there is used for the timing circuit 27 an integrated circuit, for instance MC 1455 available from Motorola Semiconductor Products Inc., which essentially contains a bistable flip-flop stage 33 controlled by two voltage comparators 31 and 32, an output amplifier 34 and two transistors $T_2$ and $T_3$, and further possesses eight external terminals or connections 1 . . . 8. The terminal "1" of the integrated switching circuit 30 is the terminal for the negative pole of the supply voltage which accordingly is connected with the output terminal $A_o$ of the supply circuit arrangement 10. In order to produce a reference voltage for both voltage comparators 31 and 32 the aforementioned IC (MC 1455) further contains a voltage divider consisting of three similar resistors $R_6$, $R_7$, $R_8$, and which is connected in the IC between the external terminal "1" and the external terminal "8" to be connected with the operating- or supply voltage $V_{CC}$. The first voltage comparator 31 receives at its one input from the voltage divider $R_6$, $R_7$ and $R_8$ a reference voltage of $\frac{1}{3} V_{CC}$. The other input of this voltage comparator 31 is connected with the external terminal "2" and its output at the adjusting or setting input of the bistable flip-flop stage 33. With the second voltage comparator 32 the one input is connected with the voltage divider $R_6$, $R_7$, $R_8$ for a reference voltage of $\frac{2}{3} V_{CC}$, the other input is connected with the external terminal "6" and the output is connected with the resetting input of the bistable flip-flop stage 33. The one input of this voltage comparator 32 additionally is connected at the external terminal "5" of the IC where there is connected a suppressor capacitor $C_8$. Connected with the output of the bistable flip-flop or flip-flop stage 33 are the collector of the "reset"-transistor $T_3$, the base of which is applied to the external terminal "4" of the IC, the base of the "discharge"-transistor $T_2$ and the input of the output amplifier 34, the output of which is connected with the external terminal "3" of the IC. As far as the "discharge"-transistor $T_2$ is concerned such is in this case an npn-transistor, the emitter of which is connected with the terminal "1" and the collector of which is connected at the external terminal "7" of the IC.

The relay winding 29 with the "freewheeling"-diode $D_3$ connected in parallel therewith is coupled with its one terminal at the output terminal $A_1$ of the supply circuit arrangement 10 and with its other terminal via the terminal "3" of the IC at the output of the output amplifier 34, so that in accordance with a low or high peak of the output voltage of the output amplifier 34 the relay 26 can be energized or de-energized.

The external circuitry of the integrated switching circuit 30, that is the IC MC 1455, consists of the RC-timing element 35, and with the block circuit diagram of FIG. 3 the circuit 28 thereof for setting the starting conditions for the bistable flip-flop stage 33. The RC-element 35 consisting of a fixed resistor $R_3$, an adjustable resistor $R_4$ and a capacitor $C_2$, all of which are connected in series, is connected at the resistor-side at the output terminal $A_2$ and at the terminal "8" of the IC and at the capacitor-side at the output terminal $A_o$ of the supply circuit arrangement 10 and at the terminal "1" of the IC. The junction 36 between the resistor $R_4$ and capacitor $C_2$ of the RC-timing element 35 is applied to the terminal "6" and to the terminal "7" of the IC and is therefore connected with the second voltage comparator 32 and the collector of the "discharge"-transistor $T_2$, so that when the transistor $T_2$ is rendered conductive the capacitor $C_2$ discharges through the collector-emitter path of the transistor $T_2$ and with the transistor $T_2$ non-conductive the capacitor $C_2$ is charged via the resistors $R_3$ and $R_4$ and its charging voltage compared with $\frac{2}{3} V_{CC}$ in the second voltage comparator 33. If the charging voltage of the capacitor $C_2$ has attained the voltage value $\frac{2}{3} V_{CC}$, then by means of the output signal of the second voltage comparator 32 the bistable flip-flop stage 33 is reset and thus the "discharge"-transistor $T_2$ is rendered conductive, and additionally the output signal of the output amplifier is adjusted to low voltage peak so that the relay 26 responds.

The circuit 28 for adjusting the starting conditions for the bistable flip-flop 33 contains a Zener diode $D_4$, the Zener voltage of which corresponds to the voltage value at which the integrated switching circuit 30 is fully activated, and a resistor or resistance $R_9$ with which there is connected in parallel a capacitor $C_3$. The Zener diode $D_4$ is connected between the output terminal $A_2$ of the supply circuit arrangement 10 and the terminal "2" of the IC and thus provides a connection between the supply voltage $V_{CC}$ and the signal input of the first voltage comparator 31 which compares the applied voltage with $\frac{1}{3} V_{CC}$. The resistor $R_9$ connects the terminal "2" of the IC with the terminal $A_o$ of the supply circuit arrangement 10, i.e. with ground.

When the voltage applied via terminal "2" to the signal input of the first voltage comparator 31 is smaller than $\frac{1}{3} V_{CC}$, then with fully activated integrated switching circuit 30 the bistable flip-flop 33 should be set so that the "discharge"-transistor $T_2$ is blocked for a charging of the capacitor $C_2$ and the output of the output amplifier 34 is set to a high signal peak.

Upon switching-in the supply circuit arrangement 10 the supply voltage $V_{CC}$ increases continuously due to the internal resistance of the transformer 11 and the full wave rectifier 12*a* and the capacitance of the capacitor $C_1$. In the time where the supply voltage is still below the Zener voltage of the Zener diode $D_4$, the terminal "2" i.e. the signal input of the first voltage comparator 31 is connected via the resistor $R_9$ with ground and thus there is prepared the charging of the capacitor $C_2$ of the RC-timing element 35. When the supply voltage exceeds the value of the Zener voltage and amounts to approximately 3/2 thereof, i.e. the integrated switching circuit 30 is fully activated, then this incipient forced triggering is stopped and the timing operation started by setting the bistable flip-flop 33.

In FIG. 5 there is illustrated a circuit diagram for a cut-off delayed timing relay with a supply circit arrangement according to FIG. 2. Here also there is used for the timing circuit of this cut-off delayed timing relay an integrated switching circuit 30, and specifically the previously described IC MC 1455. Since with this timing relay the cut-off delay again is determined by the charging time of the timing element-capacitor $C_2$ the external circuitry of the integrated switching circuit 30 is somewhat different than for the cut-in delayed timing relay of FIG. 4. In this case the relay winding 29 is connected via the collector-emitter path of a "switching"-transistor $T_6$ with the ground conductor 25. The base of the "switching"-transistor $T_6$ is connected via a resistor $R_{19}$ with ground and is connected via a resistor $R_{17}$ through the agency of the terminal "3" of the IC with the output of the output amplifier 34, so that the relay winding 29 is energized when the "switching"-transistor $T_6$ is rendered conductive by a high signal peak of the output amplifier 34. The terminal "2" of the first voltage comparator 31 is connected with a trigger circuit 37 where it is connected by a resistor $R_{18}$, with which there is connected in parallel a capacitor $C_7$, with the output terminal $A_2$ of the supply circuit arrangement 10 and by the collector-emitter path of a transistor $T_5$ with ground. The base of the transistor $T_5$ is connected via a resistor $R_{16}$ with ground and is connected via a resistor $R_{15}$ and a conductor 38 at a control circuit 40, by means of which the transistor $T_5$ of the trigger circuit 37 can be rendered conductive with the contact S closed. Thus, there is applied to the terminal "2" of the first signal comparator 31 a signal voltage smaller than $\frac{1}{3}V_{CC}$ and consequently, as described previously for the cut-on delayed timing relay of FIG. 4, the bistable flip-flop 33 is set, the "discharge"-transistor $T_2$ is switched into its blocking or nonconductive state and the output amplifier 34 is set to high output signal peak and thus by virtue of the conductive "switching"-transistor $T_6$ the relay winding 29 is energized. The circuit 28, consisting of a resistor $R_9$ and a Zener diode $D_4$ as with the timing relay of FIG. 4, for setting the starting condition upon switching-in the supply voltage is connected in this case with the terminal "4" of the IC. Hence, after switching-in the timing relay the ascending supply voltage connects the base of the "reset"-transistor $T_3$ via the resistor $R_9$ with ground and thus the "discharge"-transistor $T_2$ is pre-triggered until the supply voltage exceeds the Zener voltage of the diode $D_4$. With the second voltage comparator 32 of the integrated switching circuit 30 the reference voltage is not exactly adjusted to $\frac{2}{3}V_{CC}$ as was the case for the timing relay of FIG. 4 rather is rendered variable by a potentiometer $R_{14}$ connected parallel to the voltage divider $R_6$, $R_7$, $R_8$ and the tap of which is connected via the terminal "5" of the IC with the reference voltage input of the second voltage comparator and via a protection capacitor $C_6$ with ground. The signal voltage input of the second voltage comparator 32 is connected via the terminal "6" of the IC with the junction 36 between the resistors $R_3$, $R_4$, $R_5$ and the capacitor $C_2$ of the timing element 35. This junction or connection point 36 of the timing element 35 is furthermore also connected with the terminal "7" of the IC, i.e. at the collector of the "discharge"-transistor $T_2$ and additionally is connected via the collector-emitter path of a second "discharge"-transistor $T_4$ with ground, so that the timing element-capacitor $C_2$ can only charge when both "discharge"-transistors $T_2$ and $T_4$ are simultaneously blocked or non-conductive. For control purposes the base of the second "discharge"-transistor $T_4$ is connected via a resistor $R_{12}$ with the output conductor 38 of the control circuit 40. As the control circuit 40 there is here used a series circuit connected in parallel to the smoothing means 21 i.e. the smoothing capacitor $C_1$ of the second supply circuit 17. This series circuit comprises a control contact S, a resistor $R_{10}$ and a capacitor $C_4$, the output conductor 38 is connected at the junction or connection point 39 between the resistor $R_{10}$ and the capacitor $C_4$.

With the operating voltage switched-on and closed control contact S the smoothing capacitor $C_1$ and the control circuit capacitor $C_4$ are charged, and the second "discharge"-transistor $T_4$ as well as the trigger transistor $T_5$ of the trigger circuit 37 are rendered conductive. The first "discharge"-transistor $T_2$, as mentioned, is switched into the non-conductive state and the relay winding 29 is energized. The timing element-capacitor $C_2$ is discharged by the conductivity switched second "discharge"-transistor $T_4$. Upon opening the control contact S the second "discharge"-transistor $T_4$ and the trigger transistor $T_5$ are non-conductive. The blocking of the trigger transistor $T_4$ does not alter the switching state of the bistable flip-flop 33, so that the first "discharge"-transistor still is non-conductive and the relay 29 remains energized via the conductive "switching"-transistor $T_6$. Due to the second "discharge"-transistor $I_4$ being switched into its non-conductive state upon opening the control contact S the charging of the timing element-capacitor $C_2$ begins. As soon as the charging voltage has reached the reference voltage value set by means of the potentiometer $R_{14}$ then by means of the output signal of the second voltage comparator 32 the bistable flip-flop is reset and hence the first "discharge"-transistor $T_2$ is switched into its conductive state and at the same time the output amplifier 34 is set to low output signal peak, so that the timing element-capacitor $C_2$ will discharge and the "switching"-transistor $T_6$ blocks, with the result that the relay winding 29 is de-energized For timing relays, cut-on delayed and cut-off delayed relays, with the same construction of the supply circuit arrangement 10 there can be used also other known timing circuits, wherein in any case due to the special construction of the previously described supply circuit arrangement there are retained the previously mentioned advantages, good response characteristics, high timing accuracy and short times for again assuming a ready state. The same supply circuit arrangement 10 can also be used to advantage in other electrical devices of the previously mentioned type.

While there are shown and described present preferred embodiments of the invention, it is to be distinctly understood that the invention is not limited thereto, but may be otherwise variously embodied and practiced within the scope of the following claims.

Accordingly, what is claimed is:

1. A circuit arrangement in an electrical device containing a load which can be supplied with a direct-current voltage of lesser quality and electronic components which can be supplied with a direct-current voltage of greater quality, especially in a timing relay, for supplying the device with energy from an alternating-current network by means of voltage transforming means which can be connected with the alternating-current network and a rectifier arrangement connected in circuit thereafter, the improvement comprising: the rectifier arrangement having an output, a first supply branch connect ed in circuit with said output, a second supply branch connected in circuit with said output, said second supply branch including smoothing means and voltage stabilizer means, reverse current-blocking means for connecting said second supply branch with said output, the load which is to be supplied with the direct-current voltage of lesser quality being connected with the first supply branch and the electronic components which are to be supplied with the direct-current voltage of greater quality being connected with the second supply branch, voltage limiter means for maintaining the voltage peak in the first supply branch less than the amplitude of the rectified voltage delivered by the rectifier arrangement, the load supplied with the direct-current voltage of lesser quality including a relay having a winding connected with the first supply branch, the electronic components to be supplied with the direct-current voltage of greater quality comprising a timing circuit, bistable flip-flop stage provided for the timing circuit, circuit means for determining the starting conditions for the bistable flip-flop stage, said timing circuit with the bistable flip-flop stage and said circuit means being connected in circuit with the second supply branch.

2. The circuit arrangement as defined in claim 1, wherein the timing circuit comprises an integrated switching circuit incorporating the bistable flip-flop stage, a first voltage comparator for setting the bistable flip-flop stage and a second voltage comparator for resetting the bistable flip-flop stage, a voltage divider for producing reference voltages for the first and second voltage comparators, and output amplifier controlled by an output signal of the bistable flip-flop stage, a first "discharge"-transistor controlled by the output signal of the bistable flip-flop stage, said timing circuit further including a timing element composed of a series connection of resistors and a capacitor, said timing element and said voltage divider of the integrated switching circuit being connected with the second supply branch, the capacitor of the timing circuit being connected in parallel with the collector-emitter path of the first "discharge"-transistor, a junction point between the resistors of the timing element and the capacitor of the timing element being connected with a signal input of the second voltage comparator, the output amplifier having an output at which appears an output signal which controls the relay connected with the first supply branch, so that the switching time delay of the relay is determined by the charging time of the timing element-capacitor from the moment of blocking of the first "discharge"-transistor until charging of the timing element-capacitor to the reference voltage value applied at the second voltage comparator.

3. A circuit arrangement in an electrical device containing a load which can be supplied with a direct-current voltage of lesser quality and electronic components which can be supplied with a direct-current voltage of greater quality, especially in a timing relay, for supplying the device with energy from an alternating-current network by means of voltage transforming means which can be connected with the alternating-current network and a rectifier arrangement connected in circuit thereafter, the improvement comprising: the rectifier arrangement having an output, a first supply branch connected in circuit with said output, a second supply branch connected in circuit with said output, said second supply branch including smoothing means and voltage stabilizer means, reverse current-blocking means for connecting said second supply branch with said output, the load which is to be supplied with the direct-current voltage of lesser quality being connected with the first supply branch and the electronic components which are to be supplied with the direct-currrent voltage of greater quality being connected with the second supply branch, voltage limiter means for maintaining the voltage peak in the first supply branch less than the amplitude of the rectified voltage delivered by the rectifier arrangement, the load supplied with the direct-current voltage of lesser quality including a relay having a winding connected with the first supply branch, the electronic components to be supplied with the direct-current voltage of greater quality comprising a timing circuit, bistable flip-flop stage provided for the timing circuit, circuit means for determining the starting conditions for the bistable flip-flop stage, said timing circuit with the bistable flip-flop stage and said circuit means being connected in circuit with the second supply branch, said timing circuit comprising an integrated switching circuit incorporating the bistable flip-flop stage, a first voltage comparator for setting the bistable flop-flop stage and a second voltage comparator for resetting the bistable flip-flop stage, a voltage divider for producing reference voltages for the first and second voltage comparators, and output amplifier controlled by an output signal of the bistable flip-flop stage, a first "discharge"-transistor controlled by the output signal of the bistable flip-flop stage, said timing circuit further including a timing element composed of a series connection of resistors and a capacitor, said timing element and said voltage divider of the integrated switching circuit being connected with the second supply branch, the capacitor of the timing circuit being connected in parallel with the collector-emitter path of the first "discharge"-transistor, a junction point between the resistors of the timing element and the capacitor of the timing element being connected with a signal input of the second voltage comparator, the output amplifier having an output at which appears an output signal which controls the relay connected with the first supply branch, so that the switching time delay of the relay is determined by the charging time of the timing element-capacitor from the moment of blocking of the first "discharge"-transistor until charging of the timing element-capacitor tc the reference voltage value applied at the second voltage comparator, said arrangement being employed in a cut-in delayed timing relay, wherein said circuit means for determining the starting conditions for the bistable flip-flop stage and connected with the second supply branch comprises a resistor by means of which a signal input of the first voltage comparator is connected with ground, a Zener diode by means of which the supply voltage is applied to the signal input of the first voltage comparator, so that there is eliminated the initial triggering of the first voltage comparator brought about by the ground connection after the cut-in operation when the rise of the supply voltage exeeds the Zener voltage and the bistable flip-flop stage is placed by an output signal of the first voltage comparator into a switching state where the "discharge"-transistor is rendered non-conductive for charging of the timing element-capacitor and the output amplifier is controlled to a high output signal peak for de-energizing the relay.

4. A circuit arrangement in an electrical device containing a load which can be supplied with a direct-current voltage of lesser quality and electronic components which can be supplied with a direct-current voltage of greater quality, especially in a timing relay, for supplying the device with energy from an alternating-current network by means of voltage transforming means which can be connected with the alternating-current network and a rectifier arrangement connected in circuit thereafter, the improvement comprising: the rectifier arrangement having an output, a first supply branch connected in circuit with said output, a second supply branch connected in circuit with said output, said second supply branch including smoothing means and voltage stabilizer means, reverse current-blocking means for connecting said second supply branch with said output, the load which is to be supplied with the direct-current voltage of lesser quality being connected with the first supply branch and the electronic components which are to be supplied with the direct-current voltage of greater quality being connected with the second supply branch, voltage limiter means for maintaining the voltage peak in the first supply branch less than the amplitude of the rectified voltage delivered by the rectifier arrangement, the load supplied with the direct-current voltage of lesser quality including a relay having a winding connected with the first supply branch, the electronic components to be supplied with the direct-current voltage of greater quality comprising a timing circuit, bistable flip-flop stage provided for the timing circuit, circuit means for determining the starting conditions for the bistable flip-flop stage, said timing circuit with the bistable flip-flop stage and said circuit means being connected in circuit wiith the second supply branch, said timing circuit comprising an integrated switching circuit incorporating the bistable flip-flop stage, a first voltage comparator for setting the bistable flip-flop stage and a second voltage comparator for resetting the bistable flip-flop stage, a voltage divider for producing reference voltages for the first and second voltage comparators, and output amplifier controlled by an output signal of the bistable flip-flop stage, a first "discharge"-transistor controlled by the output signal of the bistable flip-flop stage, said timing circuit further including a timing element composed of a series connection of resistors and a capacitor, said timing element and said voltage divider of the integrated switching circuit being connected with the second supply branch, the capacitor of the timing circuit being connected in parallel with the collector-emitter path of the first "discharge"-transistor, a junction point between the resistors of the timing element and the capacitor of the timing element being connected with a signal input of the second voltage comparator, the output amplifier having an output at which appears an output signal which controls the relay connected with the first supply branch, so that the switching time delay of the relay is determined by the charging time of the timing element-capacitor from the moment of blocking of the first "discharge"-transistor until charging of the timing element-capacitor to the reference voltage value applied at the second voltage comparator, said arrangement being employed in a cut-off delayed timing relay, wherein there are connected with the first supply branch the relay winding and the collector-emitter path of a "switching"-transistor controlled by the output signal of the output amplifier, said "switching"-transistor being connected in series with said relay winding, said second supply branch having further connected therewith a trigger circuit for triggering the first voltage comparator by applying a trigger-signal voltage, and wherein the timing element-capacitor is connected in parallel with the collector-emitter path of a second "discharge"-transistor, a control circuit provided for the trigger circuit and the second "discharge"-transistor, said control circuit having an external actuated control contact, said control contact when in a closed position rendering conductive the second "discharge"-transistor for discharge of the timing element-capacitor and via the first voltage comparator blocking the first "discharge"-transistor and rendering conductive the "switching"-transistor for energizing the relay, and upon opening the control contact rendering non-conductive the second "discharge"-transistor for charging of the timing element-capacitor.

5. The circuit arrangement as defined in claim 4, wherein said circuit means for determining the starting conditions and connected with the second supply branch comprises a resistor means and a Zener diode connected in series therewith, a transistor element having a base provided in the integrated switching circuit, the collector-emitter path of said transistor element being connected in circuit with the base of the first "discharge"-transistor, said resistor means connecting the base of said transistor element with ground and via the Zener diode with the supply voltage.

6. The circuit arrangement as defined in claim 4, wherein the trigger circuit connected with the second supply branch for the first voltage comparator comprises a transistor element and a resistor means connected in series with the collector-emitter path of said transistor element, the first voltage comparator having a signal input, the signal input of the first voltage comparator being connected via the collector-emitter path of said transistor element with ground and via the resistor means with the supply voltage.

7. The circuit arrangement as defined in claim 6, wherein the control circuit for the trigger circuit and the second "discharge"-transistor comprises a series circuit connected parallel to the smoothing means in the second supply branch, said parallel connected series circuit comprising the control contact, a resistor and a capacitor, and the base of the second "discharge"-transistor and the base of the trigger circuit-transistor element being connected via a respective resistor with a junction point of said control circuit-capacitor and said control circit-resistor.

8. A circuit arrangement in an electrical device containing a load which can be supplied with a direct-current voltage of lesser quality and electronic components which can be supplied with a direct-current voltage of greater quality, especially in a timing relay, for supplying the device with energy from an alternating-current network by means of voltage transforming means which can be connected with the alternating-current network and a rectifier arrangement connected in circuit thereafter, the improvement comprising: the rectifier arrangement having an output, a first supply branch connected in circuit with said output, a second supply branch connected in circuit with said output, said second supply branch including smoothing means and voltage stabilizer means, reverse current-blocking means for connecting said second supply branch with said output, the load which is to be supplied with the direct-current voltage of lesser quality being connected with the first supply branch and the electronic components which are to be supplied with the direct-current voltage of greater quality being connected with the second supply branch, voltage limiter means for maintaining the voltage peak in the first supply branch less than the amplitude of the rectified voltage delivered by the rectifier arrangement, the second supply branch containing as the reverse current-blocking means a diode, as the smoothing means a capacitor and as the voltage stabilizer means a resistor and a Zener diode, and the first supply branch contains as the voltage limiter means a transistor at the base of which there is applied via a resistor the stabilized voltage of the second supply branch.

* * * * *